US012012245B2

(12) United States Patent
Nakamoto

(10) Patent No.: US 12,012,245 B2
(45) Date of Patent: Jun. 18, 2024

(54) BAG PROCESSING MACHINE

(71) Applicant: PACRAFT Co., Ltd., Tokyo (JP)

(72) Inventor: Kakue Nakamoto, Yamaguchi-ken (JP)

(73) Assignee: PACRAFT CO., LTD., Tokyo (JP)

( * ) Notice: Subject to any disclaimer, the term of this patent is extended or adjusted under 35 U.S.C. 154(b) by 0 days.

(21) Appl. No.: 17/724,023

(22) Filed: Apr. 19, 2022

(65) Prior Publication Data

US 2022/0340320 A1 Oct. 27, 2022

(30) Foreign Application Priority Data

Apr. 27, 2021 (JP) ..... 2021-075314

(51) Int. Cl.

| | |
|---|---|
| ***B65B 43/56*** | (2006.01) |
| ***B65B 39/12*** | (2006.01) |
| ***B65B 43/46*** | (2006.01) |
| ***B65B 43/50*** | (2006.01) |
| ***B65B 43/60*** | (2006.01) |

(52) U.S. Cl.

CPC ..... *B65B 43/56* (2013.01); *B65B 39/12* (2013.01); *B65B 43/465* (2013.01); *B65B 43/50* (2013.01); *B65B 43/60* (2013.01)

(58) Field of Classification Search

CPC ..... B65B 39/12; B65B 43/465; B65B 43/50; B65B 43/56; B65B 43/60

USPC ..... 53/249, 250, 252, 570; 141/166

See application file for complete search history.

(56) References Cited

U.S. PATENT DOCUMENTS 3,893,600 A * 7/1975 Shields ..... B65B 39/12 251/9
5,845,466 A * 12/1998 Laudenberg ..... B65B 43/465 53/550
6,199,601 B1 * 3/2001 Laudenberg ..... B65B 43/60 141/114
6,244,307 B1 6/2001 Araki et al.
8,684,048 B2 * 4/2014 Koga ..... B65B 39/12 141/147

(Continued)

FOREIGN PATENT DOCUMENTS

CN 1743233 A * 3/2006
EP 1247767 B1 10/2002

(Continued)

OTHER PUBLICATIONS

Extended European Search Report dated Oct. 10, 2022, issued in corresponding European Patent Application No. 22170282.2 (8 pgs.).

*Primary Examiner* — Stephen F. Gerrity
(74) *Attorney, Agent, or Firm* — Pillsbury Winthrop Shaw Pittman, LLP

(57) ABSTRACT

A bag processing machine includes: a rotation body which is intermittently rotated; a plurality of holding units which are attached to the rotation body and are moved along a circular movement path in accordance with rotation of the rotation body, the movement path being divided into a plurality of processing sections; a fixation support member which is positioned above the rotation body and does not rotate by rotation of the rotation body; and two or more processing devices which are supported by the fixation support member and perform processes on bags held by the plurality of holding units in two or more processing sections respectively of the plurality of processing sections.

6 Claims, 4 Drawing Sheets

(56) References Cited

U.S. PATENT DOCUMENTS

| | | | | |
|---|---|---|---|---|
| 9,096,333 | B2 * | 8/2015 | Honda | B65B 43/50 |
| 2009/0308031 | A1 | 12/2009 | Koga et al. | |
| 2019/0062086 | A1 | 2/2019 | Nakagawa | |

FOREIGN PATENT DOCUMENTS

| | | | | |
|---|---|---|---|---|
| EP | 1770018 | A1 | | 4/2007 |
| JP | S6130546 | B2 | * | 7/1986 |
| JP | 05-028169 | Y2 | * | 7/1993 |
| JP | 5-28169 | Y2 | | 7/1993 |
| JP | 6-156440 | A | | 6/1994 |
| JP | 2005008256 | A | * | 1/2005 |
| JP | 2009-298418 | A | | 12/2009 |
| JP | 2011-240962 | A | | 12/2011 |

* cited by examiner

BAG PROCESSING MACHINE

CROSS-REFERENCE TO RELATED APPLICATIONS

This application is based upon and claims the benefit of priority from Japanese Patent Application No. 2021-75314, filed on Apr. 27, 2021; the entire contents of which are incorporated herein by reference.

TECHNICAL FIELD

The present disclosure is related to a bag processing machine.

BACKGROUND ART

Bag processing machines in which a plurality of bags are conveyed in a sequential manner in such a manner that each bag travels around a plurality of processing stations are known (see, for instance, Japanese patent application publication Nos. 2011-240962 and 2009-298418 and Japanese examined utility model application publication No. 5-28169). In the plurality of processing stations, each bag undergoes various processes, such as putting contents thereinto and sealing of the mouth portion.

SUMMARY OF INVENTION

In a bag processing machine, a rotary table is caused to rotate in a state where bags are respectively held by a plurality of holding units (such as grippers) attached to the outer periphery portion of the rotary table, so that each bag moves along a circular path to travel around a plurality of processing stations.

In this case, various processing devices which perform processing on each bag are placed, outside the circular path of each bag, on a supporting base. In other words, various processing devices are located in positions which are further away from the circular path of each bag in a radial direction from the center of rotation of the rotary table. In particular, these processing devices are often placed on the same supporting base. Therefore, it is necessary to prepare a supporting base with a larger planar size than that of the rotary table for the installation of various processing devices.

On the other hand, if dirt adheres to the supporting base, the supporting base needs to be cleaned. In particular, when a process for feeding a food into a bag is carried out in a bag processing machine, the supporting base needs to be cleaned at a high frequency in order to keep the processing environment clean. If the supporting base has a large planar size, there is a lot of trouble in performing such cleaning of the supporting base. In particular, when the planar size of the supporting base is larger than the area where people can reach or when a processing device has a complex shape, it is easy to create an unreachable area or a blind spot, making it difficult to properly clean the supporting base.

Further, as the planar size of the supporting base increases, the area (in particular, the planar size) required for the installation of devices tends to increase.

The present disclosure has been contrived in view of the above-mentioned circumstances, and an object of the present disclosure is to provide a technique advantageous to reduce the planar size of the area for the installation of a plurality of processing devices equipped with a bag processing machine.

One aspect of the present disclosure is directed to a bag processing machine comprising: a rotation body which is intermittently rotated; a plurality of holding units which are attached to the rotation body and are moved along a circular movement path in accordance with rotation of the rotation body, the movement path being divided into a plurality of processing sections; a fixation support member which is positioned above the rotation body and does not rotate by rotation of the rotation body; and two or more processing devices which are supported by the fixation support member and perform processes on bags held by the plurality of holding units in two or more processing sections respectively of the plurality of processing sections.

The bag processing machine may comprise: a rotary support shaft member which supports the rotation body; and a fixation support shaft member which extends inside the rotary support shaft member and supports the fixation support member.

The rotary support shaft member may be rotated by a drive source provided between a first supporting base and a second supporting base, the rotation body may rotate along with the rotary support shaft member, the first supporting base may be arranged in a position lower than the rotation body and may rotatably support the rotary support shaft member, and the second supporting base may be arranged in a position lower than the first supporting base and may support the fixation support shaft member.

While the rotation body is intermittently stopped, two or more holding units may be positioned in each of the plurality of processing sections.

At least one of the two or more processing devices may include: a movable processing unit which is provided to be able to move with respect to two ore more bags held by two or more holding units positioned in a correspond processing section; and a movement drive unit which moves the movable processing unit, and the movable processing unit may perform a same process on two ore more bags held by two or more holding units positioned in a correspond processing section.

According to the present disclosure, it is advantageous to reduce the planar size of the area for the installation of a plurality of processing devices equipped with a bag processing machine.

DESCRIPTION OF EMBODIMENTS

Figure 1:
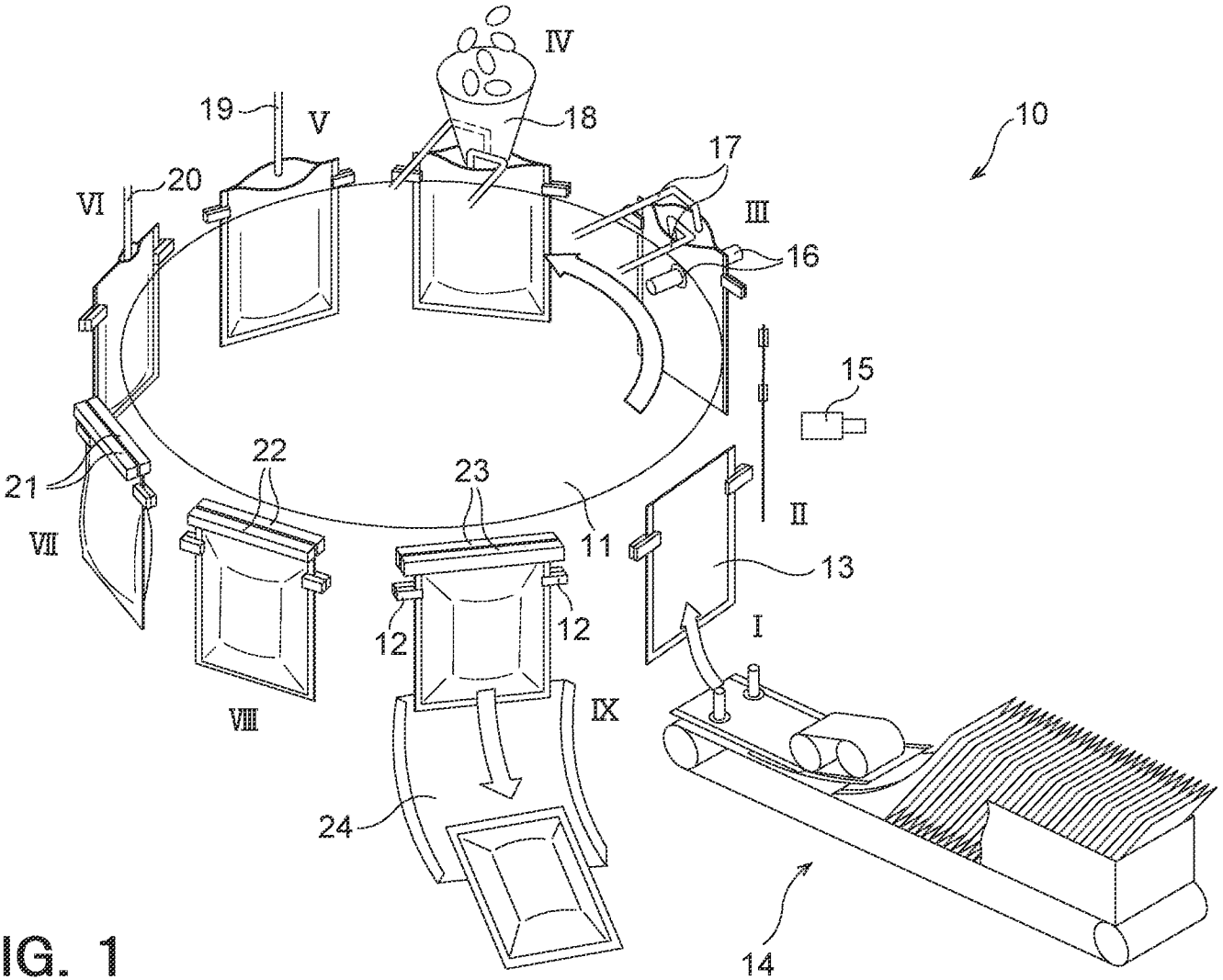
FIG. 1 is an oblique perspective view showing a schematic configuration of an example of a bag processing machine.

FIG. 1 is an oblique perspective view showing a schematic configuration of an example of a bag processing machine 10.

In FIG. 1, only a part of the bag processing machine 10 is shown, and for example, the illustration of devices that are installed higher than a rotary table 11 are omitted. An example of devices provided above the rotary table 11 is described below with reference to FIGS. 2 and 3.

The bag processing machine 10 comprises: a rotary table 11 which rotates intermittently around a central axis; and a plurality of holding units 12 (i.e., pairs of grippers provided on the left and right sides) attached to the outer periphery portion of the rotary table 11 at equal intervals (i.e., equi-angular).

The rotary table 11 repeatedly rotates and stops at predetermined angles. With the intermittent rotation of the rotary table 11, the holding units 12 move intermittently along a circular travel path. During one rotation of a holding unit 12, various packaging process are performed, such as supply of a bag 13 to the holding unit 12 (i.e., a bag feeding), opening the mouth portion of the bag 13, and feeding of contents into the bag 13, and sealing of the bag 13. The travel path of the holding units 12 is also the path of transfer path of bags 13. In FIG. 1, a drive source which intermittently rotates the rotary table 11 is omitted.

In a first processing section I shown in FIG. 1, a bag feeding step is performed. In the first processing section I, a conveyor magazine type of bag feeding device 14 which supplies bags 13 to the holding units 12 is arranged. A bag 13 supplied from the bag feeding device 14 is held at both side edge portions near the mouth portion by a pair of grippers of a holding unit 12 and is suspended in a state where the mouth portion faces upward.

In a second processing section II, a printing step is performed. In the second processing section II, a printing device 15 which prints information, such as a date, on the bag surface (i.e., on one sidewall surface) of a bag 13 being suspended by a holding unit 12, is arranged.

In a third processing section III, an opening step in which the mouth portion of a bag 13 is opened, is performed. In the third processing section III, an opening device 16 and an opening guide 17 are arranged, the opening device 16 comprises a pair of suction cups which are able to move closer to each other and further away from each other, and the opening guide 17 supports the mouth portion of a bag 13 from the inside to keep the mouth portion in an open state.

In a fourth processing section IV, a solid content feeding step in which a content (i.e., a solid content) is fed into the inside of a bag 13, is performed. In the fourth processing section IV, a solid content feeding device 18 having a hopper which lifts and lowers is located. The content supplied from a solid content supply part (not shown in the drawings) is guided by the hopper and is fed into the inside of a bag 13 through the mouth portion. The opening guide 17 is inserted into the mouth portion in the third processing section III, moves to the fourth processing section IV along with the rotation of the rotary table 11 (i.e., the movement of a holding unit 12 and a bag 13) while keeping the mouth portion in an open state, rises to move to the outside of the bag 13 after the solid content feeding device 18 (i.e., the hopper) is inserted into the mouth portion of the bag 13 in the fourth processing section IV, and after that, returns to the third processing section III.

In a fifth processing section V, a liquid injection step in which a content (i.e., a liquid content) is injected into the inside of a bag 13, is performed. In the fifth processing section V, a liquid injection device 19 having a liquid injection nozzle which lifts and lowers is arranged. The content supplied from a liquid supply part (e.g., a liquid storage tank; not shown in the drawings) is discharged from the liquid injection nozzle to be injected into the inside of a bag 13.

In a sixth processing section VI, a gas replacement step in which a gas (for example, steam such as water vapor or an inert gas such as nitrogen) is blown into the inside of a bag 13, is performed. In the sixth processing section VI, a gas blowing device 20 having a gas blowing nozzle which lifts and lowers is arranged. Gas supplied from a gas supply part (not shown in the drawings) is blown from the gas blowing nozzle to be injected into the inside of a bag 13. In the sixth processing section VI, the distance between the grippers of a holding unit 12 is increased to tighten the mouth portion of a bag 13 so as to reduce the opening area of the mouth portion.

In the seventh processing section VII, a first sealing step to seal a bag 13 (in particular, the mouth portion) is performed. In the seventh processing section VII, a first sealing device 21 having a first sealing heat unit (e.g., a pair of heating plates) which opens and closes, is arranged.

In an eighth processing section VIII, a second sealing step to seal a bag 13 (in particular, the mouth portion) is performed. In the eighth processing section VIII, a second sealing device 22 having a second sealing heat unit (e.g., a pair of heating plates) which opens and closes, is arranged.

In a ninth processing section IX, a seal part cooling step to cool a bag 13 (in particular, a seal part) and a product bag discharge step to discharge the bag 13 in which the contents are encapsulated therein (i.e., a product bag), are performed. In the ninth processing section IX, a cooling device 23 having a cooling unit that opens and closes, and a bag discharge guide 24, are arranged. In the ninth processing section IX, when the cooling unit is opened and the gripping part of each gripper is opened, a bag 13 (i.e., a product bag) is released from a holding unit 12 and the cooling device 23 to fall under the influence of gravity, and then is guided by the bag discharge guide 24 to be sent to a downstream device (for example, to a conveyor device such as a belt conveyor not shown in the drawings).

A bag 13 supported by each holding unit 12 is intermittently stopped at the above-described first processing section I to the ninth processing section IX in accordance with the intermittent rotation of the rotary table 11 and undergo processes sequentially. Various devices comprised in the bag processing machine 10 may be driven under the control of a control device (not shown in the drawings) or may be driven independently without being controlled by a control device. Two or more devices driven under the control of a control device may be driven to cooperate with each other by the control device adjusting the driving timing of the devices.

Next, an example of the overall structure of the bag processing machine 10, including devices installed above the rotary table 11, is described.

Figure 2:
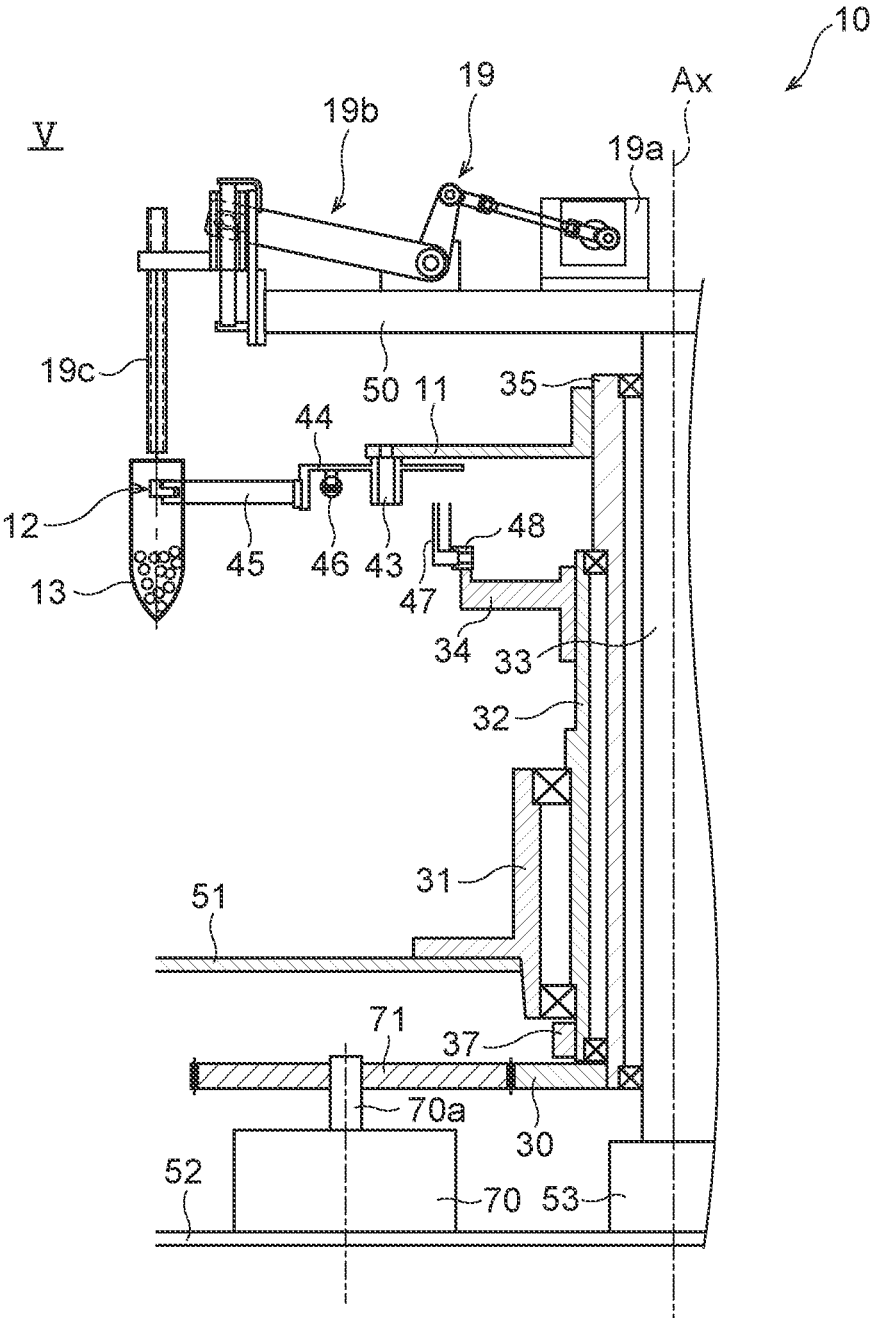
FIG. 2 shows a partial cross-sectional view of the bag processing machine in a fifth processing section.
Figure 3:
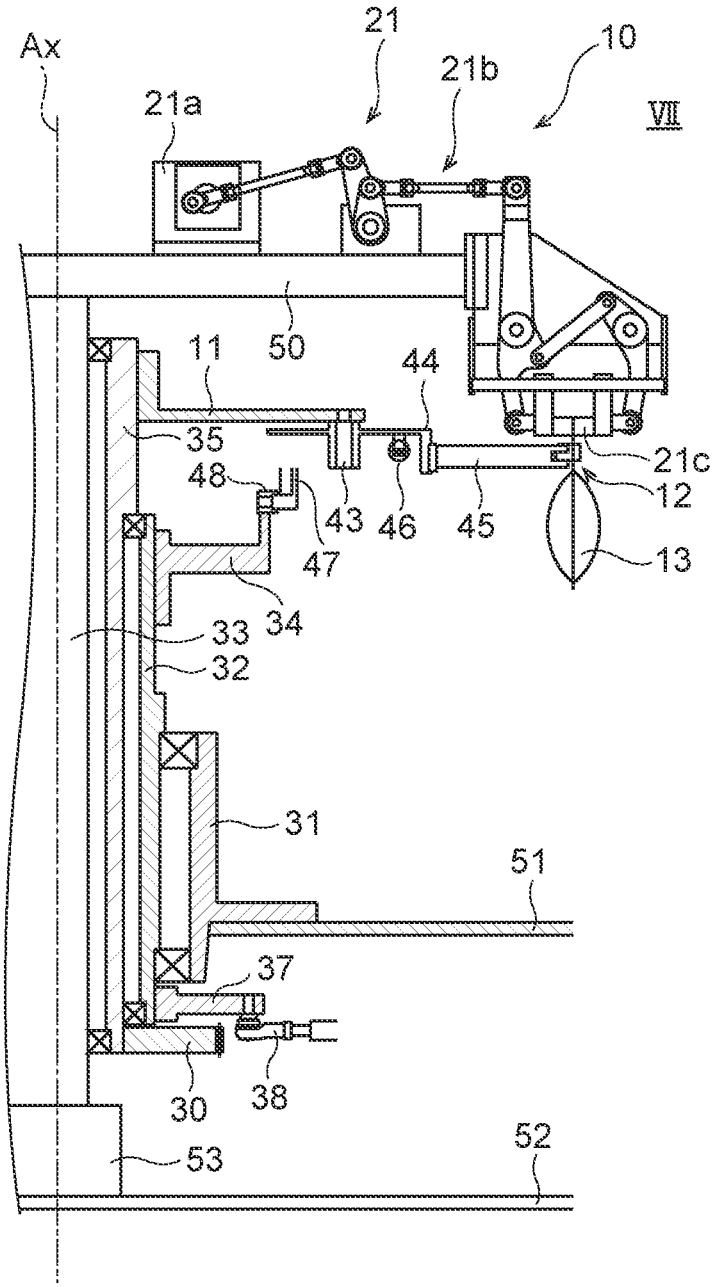
FIG. 3 shows a partial cross-sectional view of the bag processing machine in a seventh processing section.

FIG. 2 shows a partial cross-sectional view of the bag processing machine 10 in the fifth processing section V. FIG. 3 shows a partial cross-sectional view of the bag processing machine 10 in the seventh processing section VII.

In the bag processing machine 10 shown in FIGS. 2 and 3, a cylindrical stand 31 is fixedly attached to a first supporting base 51, and a rotary support shaft member 35 is provided inside the stand 31 via a hollow shaft 32 so as to rotate freely. In detail, the hollow shaft 32 is supported by the inside of the stand 31 via bearings so as to rotate freely, and the rotary support shaft member 35 is supported by the inside of the hollow shaft 32 via bearings so as to rotate freely. A drive gear 30 is fixed to the lower end of the rotary support shaft member 35. The drive gear 30 is coupled to a drive source (not show in the drawings), such as a motor, installed between a first supporting base 51 and a second supporting base 52 and rotates intermittently. The rotary support shaft member 35 rotates, integrally with the drive gear 30, in an intermittent manner. Thus, the hollow shaft 32 and the rotary support shaft member 35 rotate independently of each other around the common rotation center axis Ax.

The drive gear 30 shown in FIG. 2 is coupled, via a transfer gear 71, to the output rotation shaft 70*a* of the drive source 70 (e.g., a servomotor) attached to the upper surface of the second supporting base 52. The transfer gear 71 rotates integrally with the output rotation shaft 70*a* of the drive source 70, and the rotative power generated by the drive source 70 is transmitted from the output rotation shaft 70*a* to the drive gear 30 engaging with the transfer gear 71, so that the drive gear 30 is rotated. In this manner, the rotary support shaft member 35 (for example, the lower end part of the rotary support shaft member 35) is coupled to the drive source 70 provided between the first supporting base 51, which rotatably supports the rotary support shaft member 35, and the second supporting base 52, which supports fixation support shaft member 33, and consequently the rotary table 11 is rotated along with the rotary support shaft member 35. The first supporting base 51 and the second supporting base 52 are arranged in positions lower than the rotary table 11, and in particular, the second supporting base 52 is arranged in a position lower than the first supporting base 51. The drive source 70 is supported by the second supporting base 52 in the example shown in FIG. 2, but may be supported by the first supporting base 51 (e.g., by the lower surface of the first supporting base 51) or may be supported by another member. From a viewpoint of reducing the planar size of the bag processing machine 10, the drive source 70 is arranged in such a manner that at least part of (preferably, the entire of) the drive source 70 overlaps, in terms of the height direction (in other words, in a planar view), with at least one of the rotary table 11 and the fixation support member 50 described below.

The second supporting base 52 is located below and away from the first supporting base 51. In the space between the first supporting base 51 and the second supporting base 52, drive sources (not shown in the drawings) causing a lever 37, a rod 38 and the drive gear 30 to rotate, are installed.

An all-around cam 34 is attached to the upper end portion of the hollow shaft 32. The all-around cam 34 is provided so as to freely slide on the hollow shaft 32 in the upward-downward direction and engages with the hollow shaft 32 in the rotation direction to rotate around the rotation center axis Ax together with the hollow shaft 32. The all-around cam 34 has a substantially disked-shape portion and a cylindrical portion extending upward from the outer periphery portion of the disk-shaped portion, and the upper surface of the cylindrical portion acts as a cam surface. The all-around cam 34 can be raised and lowered by a lifting device, not shown in the drawings, to determine its position in the height direction (i.e., the upward-downward direction). The lever 37 is fixed to the lower end of the hollow shaft 32. The leading end of the rod 38, which is advanced and retracted by a cam not shown in the drawings, is coupled to the lever 37 so as to rotate freely. When the rod 38 advances and retracts, the hollow shaft 32 and the all-around cam 34 rotate, together with the lever 37, in the forward direction and in the reverse direction around the rotation center axis Ax.

The rotary table 11 is attached to the upper end portion of the rotary support shaft member 35, so that the rotary table 11 is supported by the rotary support shaft member 35. The rotary table 11 is provided so as to freely slide on the rotary support shaft member 35 in a predetermined extent in an axial direction along the rotation center axis Ax, and engages with the rotary support shaft member 35 in a rotation direction around the rotation center axis Ax so as to rotate around the rotation center axis Ax together with the rotary support shaft member 35. The rotary support shaft member 35 rotates intermittently about the rotation center axis Ax, so that the rotary table 11 is caused to intermittently rotate about the rotation center axis Ax.

A plurality of holding units 12 (gripper pairs) are attached to the periphery of the rotary table 11 at equal angle intervals, and the angular interval between adjacent holding units 12 is the same as the angle of one intermittent rotation of the rotary table 11. Similarly to a gripper pair described in Japanese patent application publication No. 2009-298418, each of the holding units 12 includes: a pair of swing levers 44 provided on the left and right sides (in FIGS. 2 and 3, only a swing lever on one side is shown) attached to a support shaft 43, fixed to the rotary table 11, so as to freely rotate; cylindrical gripper arms 45 fixed to the leading ends of the respective swing levers 44; and gripping parts attached to the leading ends of the respective gripper arms 45. An air cylinder is arranged inside each gripper arm 45 as a drive source for opening and closing a corresponding gripping part.

Two swing levers 44 included in each of the gripper pairs are inwardly urged by an extension spring 46 to receive elastic force, from the extension spring 46, in a direction closer to each other.

A rolling element 48 is placed on the cam surface of the all-around cam 34 and the rolling element 48 is supported by an L-shaped lever 47 so as to freely rotate. The rolling element 48 rolls on the cam surface of the all-around cam 34. The L-shaped lever 47 and the rolling element 48 are a part of a mechanism which causes the two swing levers 44 (and thus the two gripper arms 45 and two gripping parts) to open and close, and this mechanism has the same configuration and the same function as a mechanism described in Japanese examined utility model application publication No. 5-28169 and is attached to the rotary table 11 with respect to each of the holding units 12. When the rotary table 11 and the all-around cam 34 cause relative rotation between each other, a rolling element 48 rolls on the cam surface of the all-around cam 34. In doing so, when the cam surface on which the rolling element 48 rolls has a height difference, the L-shaped lever 47 oscillates to cause the two swing levers 44 (and thus the two gripper arms 45 and the two gripping parts) to open and close in a horizontal plane so as to change the distance between the two gripping parts.

When the rotary table 11 rotates intermittently, the all-around cam 34 also follows the rotary table 11 to rotate in a forward direction by the same angle as the rotary table 11, and consequently the relative rotation angle between the rotary table 11 and the all-around cam 34 is zero (0) and no substantial relative rotation occurs between the rotary table 11 and the all-around cam 34. On the other hand, when the rotary table 11 stops intermittently, the all-around cam 34 rotates in the opposite direction to return to its original position, and consequently a substantial relative rotation occurs between the rotary table 11 and the all-around cam 34. In this respect, the bag processing machine 10 is the same as a packaging machine described in Japanese examined utility model application publication No. 5-28169.

As in the technique disclosed in Japanese patent application publication No. 2009-298418, in the above-described bag processing machine 10, an air cylinder is used for a drive source to perform opening and closing of a gripping part of each holding unit 12, and this air cylinder is located inside a gripper arm 45. It should be noted that, as described in Japanese patent application publication No. 6-156440, the opening and closing of a gripper part of a holding unit 12 may be performed by an opening-closing drive mechanism installed in a proper place (for example, a position for a step of supplying an empty bag or a position for a step of discharging a filled bag) on the first supporting base 51 or on the second supporting base 52.

A gripper described in Japanese patent application publication No. 6-156440 includes: a pair of swing levers provided on the left and right sides attached to a table which rotates intermittently; gripper arms having base portions fixed to the respective swing levers; and gripping parts arranged on the leading ends of respective gripper arms to inwardly face each other, and each of the gripping parts includes: a fixed side gripping piece having a gripping surface directed in a radiation direction; and a movable side gripping piece attached to the leading end of a gripper arm so as to freely rotate. This gripper is similar to the gripper described in Japanese patent application publication No. 2009-298418. On a gripper arm, a connection mechanism part and a compressed spring are installed, the connection mechanism part transmits the power of the opening-closing drive mechanism to the movable side gripping piece, and the compressed spring is installed in the gripper arm to constantly urge the movable side gripping piece in a closing direction. A cylindrical member (i.e., a roller) is attached to a passive member, and when a projecting member of the opening-closing drive mechanism moves forward to press the cylindrical member in a radiation direction of the table, the movable side gripping piece opens, and when the projecting member moves backward, the movable side gripping piece is closed under the urging force of the compressed spring.

The bag processing machine 10 of the present embodiment further comprises: a fixation support shaft member 33 which is fixedly attached to the second supporting base 52 via a support fixation member 53; and a fixation support member 50 which is fixedly attached to the fixation support shaft member 33. The fixation support shaft member 33 extends in the height direction so as to penetrate the inside of the rotary support shaft member 35 and is located on the rotation center axis Ax. Bearings are provided between the rotary support shaft member 35 and the fixation support shaft member 33. The rotation of the rotary support shaft member 35 (and thus the rotary table 11) about the rotation center axis Ax does not rotate the fixation support shaft member 33.

The disk-shaped fixation support member 50 supported by the fixation support shaft member 33 is attached to the top of the fixation support shaft member 33 to be positioned above the rotary table 11 and the plurality of holding units 12. Since the rotation of the rotary support shaft member 35 supporting the rotary table 11 does not rotate the fixation support shaft member 33 supporting the fixation support member 50 as described above, the rotation of the rotary table 11 does not rotate the fixation support member 50.

According to the present embodiment, two or more processing devices which perform processes on bags 13 held by the plurality of holding units 12 in two or more processing sections respectively of the plurality of processing sections (i.e., the first processing section I to the ninth processing section IX) are supported by the fixation support member 50.

The processing devices here may include the bag feeding device 14, the printing device 15, the opening device 16, the opening guide 17, the solid content feeding device 18, the liquid injection device 19, the gas blowing device 20, the first sealing device 21, the second sealing device 22, and the cooling device 23.

For instance, in the example shown in FIG. 2, the liquid injection device 19 is supported by the fixation support member 50. The liquid injection device 19 shown in FIG. 2 comprises: a liquid injection drive source 19*a*; a liquid injection nozzle 19*c*; and a liquid injection movement mechanism 19*b* which are connected to the liquid injection drive source 19*a* and the liquid injection nozzle 19*c*. The power output from the liquid injection drive source 19*a* is transmitted to the liquid injection movement mechanism 19*b*. The liquid injection movement mechanism 19*b* operates in response to the power transmitted from the liquid injection drive source 19*a* to move the liquid injection nozzle 19*c* upward and downward in the height direction.

The specific configurations of the liquid injection drive source 19*a*, the liquid injection movement mechanism 19*b* and the liquid injection nozzle 19*c* are not limited, and the liquid injection device 19 can be configured by a known device. For example, the liquid injection drive source 19*a* may be configured by a motor or the like; and the liquid injection movement mechanism 19*b* may be configured by a mechanism (for example, a mechanism which includes a link mechanism at least in part) which converts the power transmitted from the liquid injection drive source 19*a* into power acting in the upward-downward direction. The liquid injection nozzle 19*c* can be moved upward and downward in the height direction by the power acting in the upward-downward direction transmitted from the liquid injection movement mechanism 19*b*.

Concerning the above-described liquid injection device 19, in the example shown in FIG. 2, the liquid injection drive source 19*a* and a part of the liquid injection movement mechanism 19*b* are positioned directly above the fixation support member 50 and are fixedly attached to the fixation support member 50 (in particular, to the top surface).

In the example shown in FIG. 3, the first sealing device 21 is supported by the fixation support member 50. The first sealing device 21 shown in FIG. 3 comprises: a first sealing drive source 21*a*; a first sealing heat unit 21*c*; and a first sealing movement mechanism 21*b* which are connected to the first sealing drive source 21*a* and the first sealing heat unit 21*c*. The power output from the first sealing drive source 21*a* is transmitted to the first sealing movement mechanism 21*b*. The first sealing movement mechanism 21*b* operates in response to the power transmitted from the first sealing drive source 21*a* to cause the first sealing heat unit 21*c* to perform an opening action and a closing action in a horizontal direction (in particular, in the direction of the thickness of a bag 13 held by a holding unit 12). The first sealing heat unit 21*c* heats and pressurizes the mouth portion of a bag 13 while pinching the mouth portion, to perform heat sealing on the mouth portion in such a manner that the inside of the bag 13 is sealed off.

The specific configurations of the first sealing drive source 21*a*, the first sealing movement mechanism 21*b* and the first sealing heat unit 21*c* are not limited, and the first sealing device 21 can be configured by a known device. For example, the first sealing drive source 21*a* may be configured by a motor or the like; and the first sealing movement mechanism 21*b* may be configured by a mechanism (for example, a mechanism which includes a link mechanism at least in part) which converts the power transmitted from the first sealing drive source 21*a* into power acting in a horizontal direction. The first sealing heat unit 21*c* can be caused to perform an opening action and a closing action in a horizontal direction by the power acting in a horizontal direction which is transmitted from the first sealing movement mechanism 21*b*.

Concerning the above-described first sealing device 21, in the example shown in FIG. 3, the first sealing drive source 21*a* and a part of the first sealing movement mechanism 21*b* are positioned directly above the fixation support member 50 and are fixedly attached to the fixation support member 50 (in particular, to the top surface).

In the present embodiment, of the plurality of processing devices comprised in the bag processing machine 10, processing devices which perform processes on an upper part of each bag 13 (e.g., the mouth portion and a region near the mouth portion) are at least partially positioned directly above the fixation support member 50 and are fixedly attached to the fixation support member 50 (in particular, to the top surface). On the other hand, of the plurality of processing devices comprised in the bag processing machine 10, processing devices which perform processes on parts other than the upper part of each bag 13 are fixedly attached to the first supporting base 51 (in particular, to the top surface). Specifically, the printing device 15 and the opening device 16 are supported by the first supporting base 51. On the other hand, the opening guide 17, the solid content feeding device 18, the liquid injection device 19, the gas blowing device 20, the first sealing device 21, the second sealing device 22, and the cooling device 23 are at least partially supported by the fixation support member 50 (in particular, by the top surface).

In the above example, processing devices (for example, the liquid injection device 19 (see FIG. 2) and the first sealing device 21 (see FIG. 3)) are installed on the top surface of the fixation support member 50, and those processing devices are provided on the opposite side, via the fixation support member 50, from the rotary table 11 and each holding unit 12. However, one or more processing devices may be installed on the under surface of the fixation support member 50, and the one or more processing devices may be positioned between the fixation support member 50 and the rotary table 11 in the height direction.

Also, a processing device which performs a process on a part of a bag 13 other than the upper part may be supported by the fixation support member 50. Further, a processing device which performs a process on an upper part of a bag 13 may be supported by a member other than the fixation support member 50 (for example, by the first supporting base 51 or the second supporting base 52). Furthermore, a processing device (e.g., a print inspection device) not shown in the drawings may be supported by the fixation support member 50 or may be supported by a member other than the fixation support member 50.

As described above, the bag processing machine 10 of the present embodiment comprises: a rotary table 11 (a rotation body) which is rotated intermittently; a plurality of holding units 12 which are attached to the rotary table 11 and are moved along a circular movement path in accordance with the rotation of the rotary table 11, the circular movement path being divided into a plurality of processing sections I to IX; a fixation support member 50 which is positioned above the rotary table 11 and does not rotate by the rotation of the rotary table 11; and two or more processing devices which are supported by the fixation support member 50 and perform processes on bags 13 held by the plurality of holding units 12 in two or more processing sections respectively of the plurality of processing sections I to IX.

According to this bag processing machine 10, two or more processing devices are supported by the fixation support member 50. This allows the space above the rotary table 11 to be effectively utilized to install two or more processing devices. Thus, it is advantageous to reduce the planar size of the area for the installation of a plurality of processing devices which the bag processing machine 10 comprises.

As a result, the cleanup work of the bag processing machine 10 can be carried out easily and conveniently. In addition, it is possible to reduce devices positioned outside the movement path of bags 13, to reduce the planar sizes of the first supporting base 51 and the second supporting base 52, and consequently to reduce the planar sizes of the entire bag processing machine 10.

Further, by installing processing devices on the top surface of the fixation support member 50, it is possible to effectively reduce the contamination of said processing devices by the contents (i.e., solids and liquids) during operation of the bag processing machine 10. On the other hand, by installing processing devices on the under surface of the fixation support member 50, the distance between the processing devices and bags 13 are shortened and obstructions between the processing devices and bags 13 are also reduced, which may promote simplification and downsizing of processing devices.

Further, the bag processing machine 10 of the present embodiment comprises: a rotary support shaft member 35 which supports the rotary table 11; and a fixation support shaft member 33 which extends inside the rotary support shaft member 35 and supports the fixation support member 50.

This makes it possible to firmly support the fixation support member 50 by means of the fixation support shaft member 33 while curbing the increase in the planar size of the area for the installation of the fixation support shaft member 33 and the rotary support shaft member 35.

For example, it is possible to install posts and the fixation support member in the outer region of the bag processing machine 10 (in particular, outside of the rotary table 11 in a horizontal direction), but in this case, the planar size of the entire bag processing machine 10 will be increased due to the posts and the fixation support member. On the other hand, by installing the fixation support shaft member 33 inside the rotary support shaft member 35, it is possible to easily install the fixation support member 50 above the rotary table 11 and to effectively reduce the increase in the planar size of the entire bag processing machine 10.

First Modification Example

In the present modification example, the same reference numerals are attached to the same or corresponding elements as in the embodiment described above, and their detailed descriptions are omitted.

Figure 4:
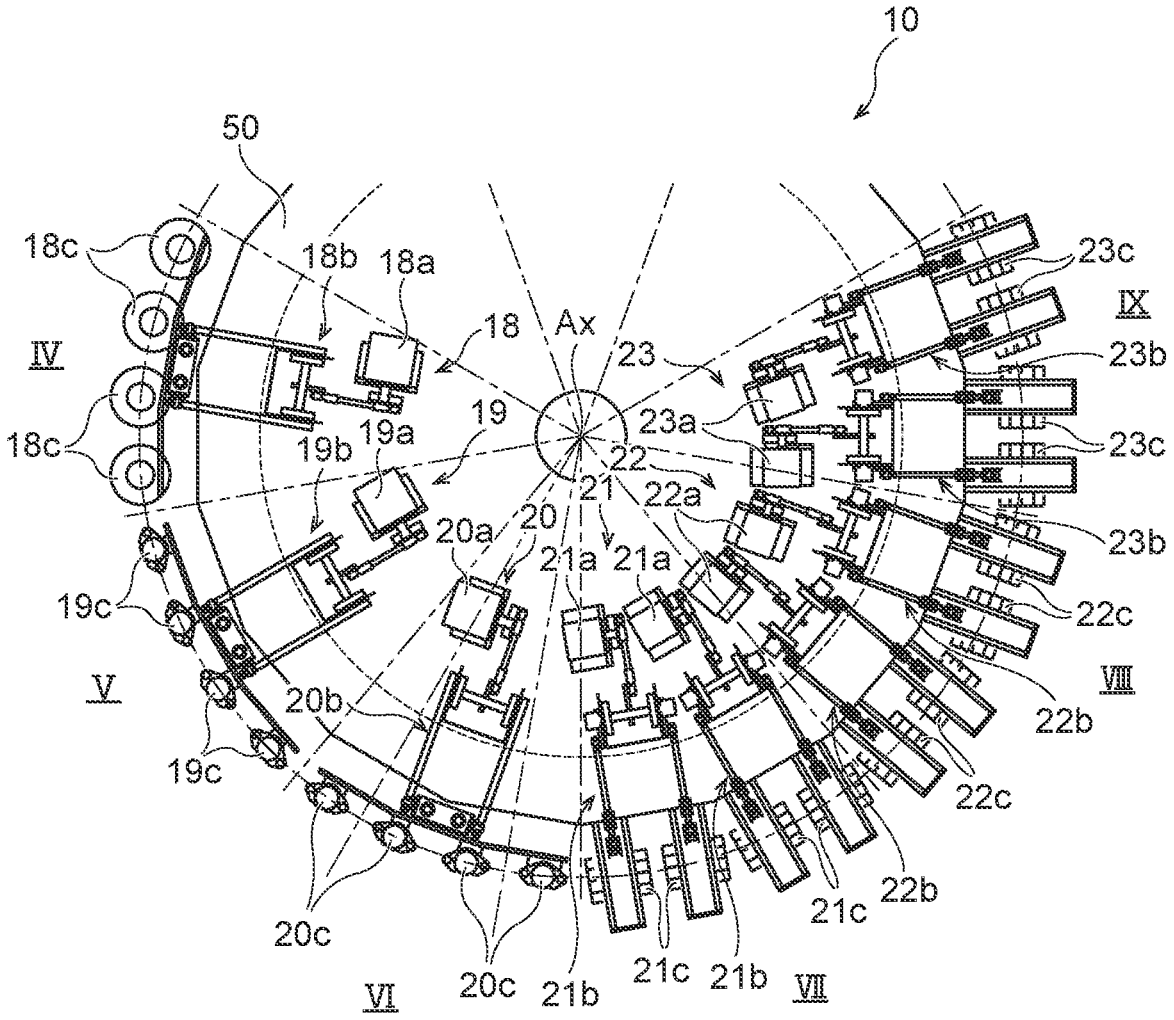
FIG. 4 is a plan view showing a bag processing machine (in particular, fourth through ninth processing sections) according to a first modification example.

FIG. 4 is a plan view of a bag processing machine 10 (in particular, the fourth processing section IV through the ninth processing section IX) according to a first modification example.

The bag processing machine 10 according to the present modification example has basically the same configuration as the bag processing machine 10 shown in FIGS. 1 to 3 described above. However, in the present modification example, while the rotary table 11 is stopped intermittently, two or more holding units 12 (specifically, four holding units 12) are arranged in each of the plurality of processing sections I-IX.

Further, movable processing units of two or more processing devices supported by the fixation support member 50 perform the same process, at the same timing, on two or more bags 13 held by two ore more holding units 12 arranged in corresponding processing sections.

In the example shown in FIG. 4, the solid content feeding device 18, the liquid injection device 19, the gas blowing device 20, the first sealing device 21, and the cooling device 23 are attached to the top surface of the fixation support member 50 and are supported by the fixation support member 50.

The solid content feeding device 18 comprises: a single solid content feeding drive source 18*a*; a plurality (specifically, four) of solid content feeding guides (e.g., hoppers) 18*c*; and a single solid content feeding movement mechanism 18*b* which is connected to the solid content feeding drive source 18*a* and each solid content feeding guide 18*c*. The power output from the solid content feeding drive source 18*a* is transmitted to the solid content feeding movement mechanism 18*b*. The solid content feeding movement mechanism 18*b* operates in response to the power transmitted from the solid content feeding drive source 18*a* to move the four solid content feeding guides 18*c* upward and downward in the height direction.

As described above, the solid content feeding device 18 includes: the four solid content feeding guides 18*c* (i.e., movable processing units) which are provided to be able to move with respect to four bags 13 held by four holding units 12 arranged in the corresponding processing section (i.e., in the fourth processing section IV); and the solid content feeding movement mechanism 18*b* which causes the four solid content feeding guides 18*c* to move.

Likewise, the liquid injection device 19 includes: a single liquid injection drive source 19*a*; a plurality (specifically, four) of liquid injection nozzles 19*c*; a single liquid injection movement mechanism 19*b* which are connected to the liquid injection drive source 19*a* and each liquid injection nozzle 19*c*. The power output from the liquid injection drive source 19*a* is transmitted to the liquid injection movement mechanism 19*b*. The liquid injection movement mechanism 19*b* operates in response to the power transmitted from the liquid injection drive source 19*a* to move the four liquid injection nozzles 19*c* upward and downward in the height direction.

Further, the gas blowing device 20 includes: a single gas blowing drive source 20*a*; a plurality (specifically, four) of gas blowing nozzles 20*c*; and a single gas blowing movement mechanism 20*b* which is connected to the gas blowing drive source 20*a* and each gas blowing nozzle 20*c*. The power output from the gas blowing drive source 20*a* is transmitted to the gas blowing movement mechanism 20*b*. The gas blowing movement mechanism 20*b* operates in response to the power transmitted from the gas blowing drive source 20*a* to move the four gas blowing nozzles 20*c* upward and downward in the height direction.

On the other hand, the first sealing device 21 includes: a plurality (specifically, two) of first sealing drive sources 21*a*; a plurality (specifically, four) of first sealing heat units 21*c*; and a plurality (specifically, two) of first sealing movement mechanisms 21*b*. One first sealing drive source 21*a* and a plurality (specifically, two) of first sealing heat units 21*c* are connected to each of the first sealing movement mechanisms 21*b*. The power output from each first sealing drive source 21*a* is transmitted to a corresponding first sealing movement mechanism 21*b*, the first sealing movement mechanism 21*b* operates in response to the power transmitted from the first sealing drive source 21*a* to cause two corresponding first sealing heat units 21*c* to perform an opening action and a closing action in a horizontal direction.

In this manner, the first sealing device 21 performs the same process, at the same timing, on two bags 13 held by two holding units arranged in the corresponding seventh processing section VII. In a case where the two first sealing drive sources 21*a* are driven in synchronization with each other and the two first sealing movement mechanisms 21*b* are driven in synchronization with each other, it is possible to perform the same process, at the same timing, on four bags 13 held by four holding units 12 arranged in the seventh processing section VII.

Likewise, the second sealing device 22 includes: a plurality (specifically, two) of second sealing drive sources 22*a*; a plurality (specifically, four) of second sealing heat units 22*c*; and a plurality (specifically, two) of second sealing movement mechanisms 22*b*. One second sealing drive source 22*a* and a plurality (specifically, two) of second sealing heat units 22*c* are connected to each second sealing movement mechanism 22*b*. The power output from each second sealing drive source 22*a* is transmitted to a corresponding second sealing movement mechanism 22*b*, the second sealing movement mechanism 22*b* operates in response to the power transmitted from the second sealing drive source 22*a* to cause two corresponding second sealing heat units 22*c* to perform an opening action and a closing action in a horizontal direction.

Likewise, the cooling device 23 includes: a plurality (specifically, two) of cooling drive sources 23*a*; a plurality (specifically, four) of cooling units 23*c*; and a plurality (specifically, two) of cooling movement mechanisms 23*b*. One cooling drive source 23*a* and a plurality (specifically, two) of cooling units 23*c* are connected to each cooling movement mechanism 23*b*. The power output from each cooling drive source 23*a* is transmitted to a corresponding cooling movement mechanism 23*b*, the cooling movement mechanism 23*b* operates in response to the power transmitted from the cooling drive source 23*a* to cause two corresponding cooling units 23*c* to perform an opening action and a closing action in a horizontal direction.

As described above, according to the present modification example, while the rotary table 11 is stopped intermittently, two or more bags 13 are arranged in each of the plurality of processing sections I to IX.

This makes it possible that a processing device supported by the fixation support member 50 can perform the same process on two or more bags 13 held by two or more holding units 12 arranged in a corresponding processing section. As a result, the processing performance in the bag processing machine 10 can be improved.

Further, at least one of the two or more processing devices includes: a movable processing unit which is provided to be able to move with respect to two or more bags 13 held by two or more holding units 12 positioned in a correspond processing section; and a movement drive unit which moves the movable processing unit, and the movable processing unit performs a same process on two ore more bags 13 held by two or more holding units 12 positioned in a correspond processing section.

This makes it possible to effectively perform processes on a large number of bags 13 while curbing the increase in the component count of processing devices. Further, even if the planar size of the fixation support member 50 is small, processing devices can be properly installed in the fixation support member 50.

In particular, in case where a movable processing unit can be moved between a position for performing a process on a corresponding bag 13 and a position for evacuating from the corresponding bag 13 by simply moving the movable processing unit of a processing device upward and downward in the height direction (see the solid content feeding device 18, the liquid injection device 19, and the gas blowing device 20 shown in FIG. 4), it is possible to move many movable processing units at one time by a single drive source and a single movement mechanism.

On the other hand, even in a case where a movable processing unit is required to be moved in a horizontal direction in accordance with the orientation of a corresponding bag 13 in order to move the movable processing unit of a processing device between a position for performing a process on a corresponding bag 13 and a position for evacuating from the corresponding bag 13 (see the first sealing device 21, the second sealing device 22, and the cooling device 23 shown in FIG. 4), it is possible to move a plurality of movable processing units at one time by a single drive source and a single movement mechanism.

Various modifications may be added to each element of the above-described embodiment and modification example, and configurations may be partially or entirely combined among the above-described embodiment and modification example. Further, the effects produced by the present disclosure are not limited to the effects described above, and specific effects based on a particular configuration of each embodiment may also be produced. As described above, various additions, changes, and partial deletions may be made to each element described in the claims, specification, and drawings without departing from the technical concept and the intent of the present disclosure.

The invention claimed is:

1. A bag processing machine comprising:

a rotation body configured to be intermittently rotated;

a plurality of holding units configured to be attached to the rotation body and configured to be moved along a circular movement path in accordance with rotation of the rotation body, the circular movement path being divided into a plurality of processing sections;

a fixation support member configured to be positioned above the rotation body and configured not to be rotated by rotation of the rotation body;

two or more processing devices configured to be supported by the fixation support member and configured to perform processes on bags held by the plurality of holding units in two or more processing sections respectively of the plurality of processing sections, a rotary support shaft member configured to support the rotation body; and a fixation support shaft member configured to extend inside the rotary support shaft member and support the fixation support member.

2. The bag processing machine as defined in claim 1, wherein the rotary support shaft member is rotated by a drive source provided between a first supporting base and a second supporting base, wherein the rotation body configured to rotate along with the rotary support shaft member, wherein the first supporting base is arranged in a position lower than the rotation body and is configured to rotatably support the rotary support shaft member, and wherein the second supporting base is arranged in a position lower than the first supporting base and is configured to support the fixation support shaft member.

3. The bag processing machine as defined in claim 2, wherein, while the rotation body is intermittently stopped, two or more holding units are positioned in each of the plurality of processing sections.

4. The bag processing machine as defined in claim 3, wherein at least one of the two or more processing devices includes:

a movable processing unit configured to move with respect to two or more bags held by two or more holding units positioned in a corresponding processing section; and a movement drive unit configured to move the movable processing unit, and wherein the movable processing unit is configured to perform the same process on two or more bags held by two or more holding units positioned in a corresponding processing section.

5. The bag processing machine as defined in claim 1, wherein, while the rotation body is intermittently stopped, two or more holding units are positioned in each of the plurality of processing sections.

6. The bag processing machine as defined in claim 5, wherein at least one of the two or more processing devices includes:

a movable processing unit configured to move with respect to two or more bags held by two or more holding units positioned in a corresponding processing section; and a movement drive unit configured to move the movable processing unit, and wherein the movable processing unit is configured to perform the same process on two or more bags held by two or more holding units positioned in a corresponding processing section.

* * * * *